United States Patent [19]

Nagashima et al.

[11] Patent Number: 4,976,020

[45] Date of Patent: Dec. 11, 1990

[54] MAGNETIC SHEET POLISHING DEVICE

[75] Inventors: Yasuo Nagashima; Haruo Soeda; Masamichi Sato, all of Tokyo; Takashi Kubo, Kanagawa, all of Japan

[73] Assignee: Fuji Photo Film Co., Ltd., Kanagawa, Japan

[21] Appl. No.: 398,303

[22] Filed: Aug. 24, 1989

Related U.S. Application Data

[63] Continuation of Ser. No. 110,821, Oct. 21, 1987, abandoned.

[30] Foreign Application Priority Data

Oct. 21, 1986 [JP] Japan ..... 61-248280
Oct. 24, 1986 [JP] Japan ..... 61-251942

[51] Int. Cl.[5] ..... B24B 39/06; B23B 27/00

[52] U.S. Cl. ..... 29/90.01; 51/132; 82/1.12; 407/1

[58] Field of Search ..... 29/90.01, 90.5; 82/1.11, 1.12, 123, 173; 493/373, 467; 51/132, 281 R, 281 SF; 407/1

[56] References Cited

U.S. PATENT DOCUMENTS 382,414 5/1888 Edison ..... 82/1.1
1,130,156 3/1915 Edison ..... 82/1.1
1,536,938 5/1925 Schiffl ..... 82/1.1
4,330,910 5/1982 Schachl et al. ..... 29/90.01
4,430,782 2/1984 Bornhorst et al. ..... 29/90.01

FOREIGN PATENT DOCUMENTS 81058 5/1984 Japan ..... 29/90.01
2166676 5/1986 United Kingdom ..... 407/1

OTHER PUBLICATIONS

Barth et al., "Magnetic Disk Treatment", IBM Technical Disclosure Bulletin, vol. 14, No. 5, 10 1971.
Slindee "Burnishing Method and Apparatus for Flexible Magnetic Disks", IBM Technical Disclosure Bulletin, vol. 19, No. 10, 03 1977.

*Primary Examiner*—William Terrell
*Attorney, Agent, or Firm*—Sughrue, Mion, Zinn, Macpeak & Seas

[57] ABSTRACT

A magnetic sheet polishing device including a scraper having a sliding surface and a downstream side surface that is nearly perpendicular or at an acute angle to the sliding surface to ensure that magnetic material powder spontaneously falls away from and does not adhere again to the magnetic material surface of the magnetic sheet after being scraped off by the scraper. Additionally, the scraper has a diagonal groove or a diagonal step formed in a side surface to check for wear of the sliding surface.

2 Claims, 2 Drawing Sheets

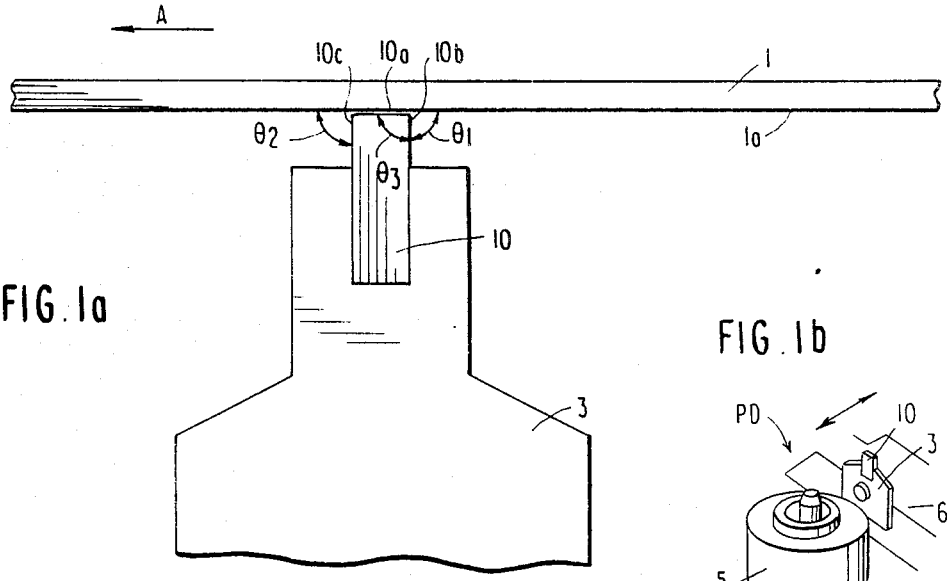
FIG. 1a
FIG. 1b
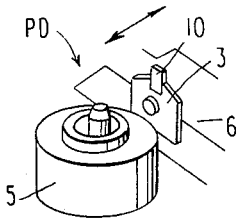
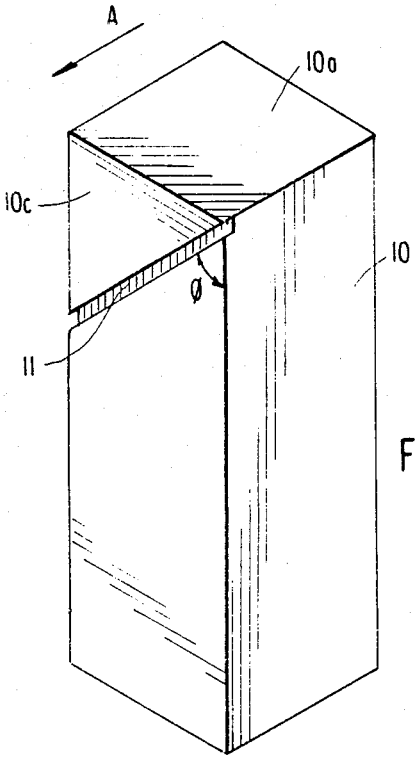
FIG. 2
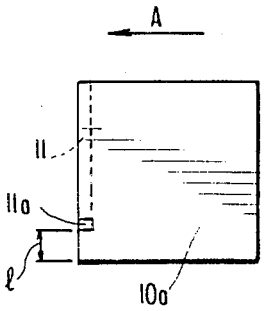
FIG. 3
FIG. 4
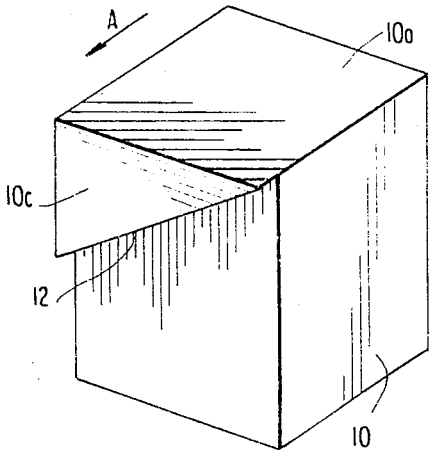
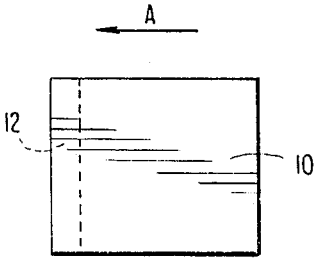
FIG. 5

MAGNETIC SHEET POLISHING DEVICE

This is a part, Continuation, of application Ser. No. 07/110,821, filed 10/27/87.

FIELD OF THE INVENTION

This invention relates to a magnetic sheet polishing device, which provides reduced occurrence of dropout and efficient burnishing work.

BACKGROUND OF THE INVENTION

A magnetic sheet pack is used as a recording medium for electronic cameras or the like. Referring to FIG. 8, a magnetic sheet pack 01 comprises a flexible magnetic sheet 03 contained in a pack 02. In a production process for such a magnetic sheet pack 01, there is a step so-called "burnishing". In the burnishing work, the magnetic sheet is rotated and a scraper is contacted against the surface of magnetic material of the rotating magnetic sheet. This grinds off lumps of magnetic material powder projecting from the surface which are formed during coating of the magnetic material powder, thereby obtaining a smooth surface of a magnetic floppy disk.

A prior art burnishing work will be briefly described with reference to FIG. 9. Referring to FIG. 9, a magnetic sheet 1 is rotated (in the direction indicated by an arrow A) by a rotational drive unit of a polishing device, and a sapphire chip as a scraper is attached to a base plate 3 at an end of a head carriage of the polishing device. The sapphire chip 2 has the same shape as a normal magnetic head, with a slightly curved sliding surface 2*a*, and both an angle $\theta 1$ between an upstream side surface 2*b* and a magnetic material surface 1*a* and an angle $\theta 2$ between a downstream side surface 2*c* and the magnetic material surface 1*a* are about 10 to 20 degrees.

When the sapphire chip 2 is moved in the radial direction of the magnetic sheet 1 while the magnetic sheet 1 is rotated, magnetic lumps projecting from the magnetic material surface 1*a* are ground off by the sapphire chip 2 to smooth the magnetic material surface 1*a*.

Magnetic tapes and sheets are normally processed by a calender to obtain smooth surfaces, thus enabling short wavelength recording. It is the object of burnishing to remove small irregularities or discrete projections which are present even after calendering, thus reducing dropouts generated before punching and making the magnetic sheet less abrasive.

The prior art method shown in FIG. 9, however, has a problem in that scraped magnetic powder 4 accumulates on the downstream side surface 2*c*, and the accumulated magnetic powder 4 may attach again to the magnetic material surface 1*a*. The attached magnetic powder 4, after one turn of the magnetic sheet, comes in between the upstream side surface 2*b* and the magnetic sheet and strongly adheres to this part of the magnetic sheet. When the track including this part of the magnetic sheet is used for recording or reproduction, the magnetic head jumps up from the magnetic material surface 1*a* due to the presence of the stuck lump of magnetic powder 4, and poor contact of the head and a dropout will result.

SUMMARY OF THE INVENTION

With a view to obviate all of the prior art defects of magnetic sheet polishing devices, it is a primary object of the present invention to provide a magnetic sheet polishing device which provides positive burnishing of even dropouts generated by itself.

An additional object of the present invention is to enable checking of wear of a scraper when it is worn.

BRIEF DESCRIPTION OF THE DRAWINGS

These and other objects as well as advantages of the present invention will become clear by the following description of a preferred embodiment of the present invention with reference to the accompanying drawings, wherein:

FIG. 1*a* is a schematic view showing structure of a first embodiment of the present invention.

FIG. 1*b* is a schematic oblique view showing a portion of the polishing device.

FIG. 2 is a schematic oblique view showing a sapphire chip.

FIG. 3 is a schematic plane view showing the sapphire chip.

FIG. 4 is a schematic oblique view showing a modification of sapphire chip.

FIG. 5 is a schematic plane view showing the modified sapphire chip.

DESCRIPTION OF THE PREFERRED EMBODIMENTS

Figure 6:
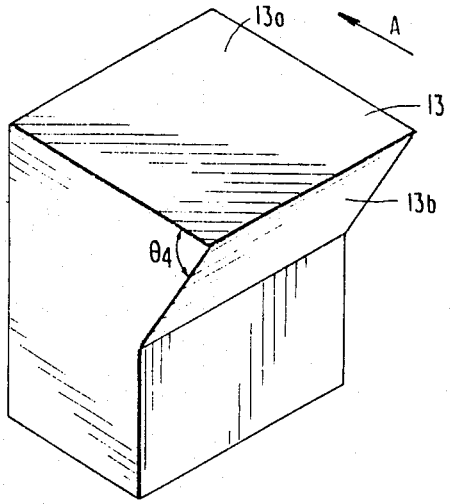
FIG. 6 is a schematic oblique view showing a sapphire chip used in a second embodiment of the present invention.

An embodiment of the present invention will be described in detail with reference to the drawings. FIG. 1*b* is a schematic view showing part of a polishing device according to the present invention. Referring to FIG. 1*b*, a magnetic sheet 1 is rotated in the direction of an arrow A, and a sapphire chip 10 as a scraper is attached to a base plate 3. Referring to FIG. 2 showing an enlarged view, the sapphire chip 10 has a prismatic form having a sliding surface 10*a* of about 0.3 mm square. Therefore, an angle $\theta 1$ between an upstream side surface 10*b* and a magnetic material surface 1*a* and an angle $\theta 2$ between a downstream side surface 10*c* and the magnetic material surface 1*a* are both 90 degrees. The side surface 10*c* is provided with a diagonal groove 11.

By virtue of the arrangement of this embodiment, when magnetic lumps on the magnetic material surface 1*a* are scraped off by the sapphire chip 10, the magnetic material powder spontaneously falls down and will not adhere again to the magnetic material surface 1*a*.

FIG. 1*b* shows a portion of the polishing device PD including a rotational drive unit 5 for rotating the magnetic sheet 1, and a head carriage 6 for supporting the base plate 3. The sapphire chip 10, which forms the scraper, is attached to the base plate 3.

When the sapphire chip 10 becomes worn, the position of an opening 11*a* of the groove 11 is shifted as shown in FIG. 3 viewed from the sliding surface 10*a*. Therefore, the amount of wear of the sapphire chip 10 can be determined by observing the position of the opening 11*a* by means of an optical microscope. For example, where $\phi$ is an angle of the groove 11, and l is a distance between the opening 11*a* and the end of the sapphire chip 10, the amount of wear is given by the following equation:

$$x = \frac{l}{\tan\phi}$$

In place of the groove 11, a step 12 can be diagonally formed on the side surface 10*c* as shown in FIG. 4 and FIG. 5 to allow the amount of wear of the sapphire chip 10 to be measured.

Figure 7A:
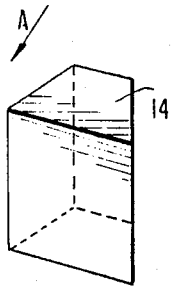
FIGS. 7(*a*) and 7(*b*) are schematic oblique views showing modifications of sapphire chip.
Figure 7B:
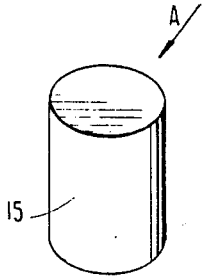
Figure 8:
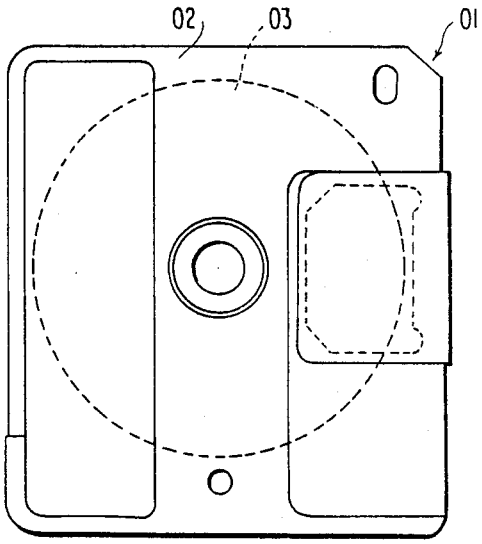
FIG. 8 is a schematic view showing structure of a magnetic sheet pack.
Figure 9:
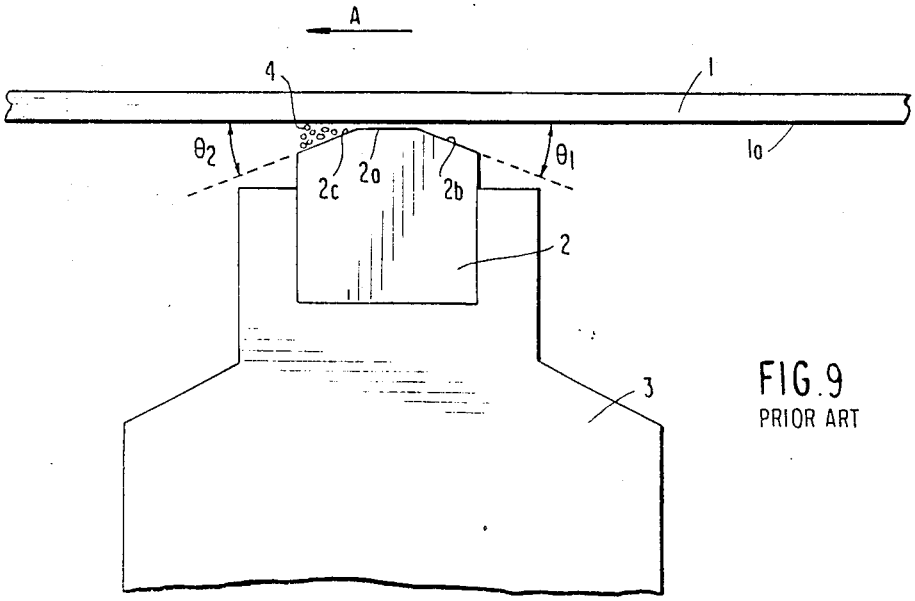
FIG. 9 PRIOR ART
FIG. 9 is a schematic view showing structure of a prior art device.

This embodiment uses a prismatic sapphire chip having a square sliding surface. However, the sapphire chip can alternatively be of a prismatic form with a trapezoidal sliding surface (FIG. 7(*a*)) or a cylindrical form (FIG. 7(*b*)).

Another embodiment of the present invention is shown in FIG. 6. Referring to FIG. 6, a sapphire chip 13 has an acute angle $\theta$4 between a square sliding surface 13*a* and a upstream side surface 13*b*. This result in a further increased shearing force of the sapphire chip, thereby providing effective burnishing work.

As described above in detail with reference to the embodiments, with the polishing device according to the present invention, in which the side surface of the scraper (sapphire chip) is nearly perpendicular to the surface of magnetic material of the magnetic sheet, scraped magnetic material powder does not accumulate, thereby preventing re-adherence of the magnetic material powder and reducing occurrence of dropout.

Further, since the upstream side surface of the scraper (sapphire chip) is slanted with an angle of about right angle or less to the sliding surface, the shearing force is increased and intrusion of magnetic powder is prevented, thereby obtaining positive burnishing effect.

We claim:

1. A magnetic sheet polishing device for smoothing the surface of a magnetic sheet, said device comprising:

a rotational drive unit for rotating said magnetic sheet;

a head carriage having a base disposed at an end thereof; and a scraper attached to said base plate for sliding against a surface of magnetic material of the rotating magnetic sheet such that magnetic lumps projecting from said surface of magnetic material are scraped off, said scraper including a substantially flat sliding surface for contiguously sliding against said surface of magnetic material, a downstream side surface intersecting with and disposed nearly perpendicular with respect to said sliding surface as measured within said scraper, intersecting with an upstream side surface disposed at an acute angle with respect to said sliding surface as measured within said scraper.

2. The device as claimed in Claim 1, wherein said sliding surface is square.

* * * * *